US009488188B2

(12) United States Patent
Ota

(10) Patent No.: US 9,488,188 B2
(45) Date of Patent: Nov. 8, 2016

(54) COMPRESSOR

(75) Inventor: Mitsuhiko Ota, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 745 days.

(21) Appl. No.: 13/993,817

(22) PCT Filed: Jul. 25, 2011

(86) PCT No.: PCT/JP2011/066812

§ 371 (c)(1),
(2), (4) Date: Jun. 13, 2013

(87) PCT Pub. No.: WO2012/114556

PCT Pub. Date: Aug. 30, 2012

(65) Prior Publication Data

US 2013/0259665 A1 Oct. 3, 2013

(30) Foreign Application Priority Data

Feb. 25, 2011 (JP) ..... 2011-040722

(51) Int. Cl.
*F04D 29/40* (2006.01)
*F04D 17/12* (2006.01)
*F04D 29/08* (2006.01)

(52) U.S. Cl.
CPC ..... *F04D 29/40* (2013.01); *F04D 17/125* (2013.01); *F04D 29/083* (2013.01)

(58) Field of Classification Search
CPC .. F04D 29/40; F04D 29/083; F04D 29/4206; F04D 29/582; F04D 29/5846; F04D 29/5853; F04D 17/125; F04D 17/10; F04D 17/12; F04D 17/122; F05B 2240/14
USPC ..... 415/214.1, 180
See application file for complete search history.

(56) References Cited

U.S. PATENT DOCUMENTS 5,087,172 A * 2/1992 Ferri ..... F04D 29/122 277/320
5,846,052 A * 12/1998 Kameda ..... F04D 29/086 415/182.1

FOREIGN PATENT DOCUMENTS

CN 2842016 11/2006
CN 101324242 12/2008

(Continued)

OTHER PUBLICATIONS

Office Action issued Mar. 2, 2015 in corresponding Chinese patent application No. 201180056706.4 (with English translation).

(Continued)

*Primary Examiner* — Eric Keasel
*Assistant Examiner* — Danielle M Christensen
(74) *Attorney, Agent, or Firm* — Wenderoth, Lind & Ponack, L.L.P.

(57) ABSTRACT

A compressor including: a substantially tubular casing; a substantially cylindrical lid that is provided inside an inner periphery of the casing so as to close off both ends of the casing; a space that is enclosed by the lid and an inner circumferential surface of the casing so as to accommodate a blade; and a seal member that is provided so as to extend in a circumferential direction on the space side of an outer circumferential surface of the lid. A recessed portion, extending inward in the radial direction from the outer circumferential surface of the lid, is provided on the lid at a position between the seal member and the end surface at the space side of the lid.

2 Claims, 3 Drawing Sheets

(56) References Cited

FOREIGN PATENT DOCUMENTS

| | | |
|---|---|---|
| CN | 101523056 | 9/2009 |
| CN | 201547027 | 8/2010 |
| CN | 101900447 | 12/2010 |
| JP | 47-24608 | 10/1972 |
| JP | 54-55505 | 4/1979 |
| JP | 55-7914 | 1/1980 |
| JP | 58-6079 | 2/1983 |
| JP | 9-88864 | 3/1997 |
| JP | 9-166220 | 6/1997 |

OTHER PUBLICATIONS

Decision to Grant a Patent issued Jun. 24, 2014 in corresponding Japanese patent application No. 2011-040722.

Partial Translation of International Search Report issued Aug. 30, 2011 in International Application No. PCT/JP2011/066812.

Partial Translation of Written Opinion of the International Searching Authority issued Aug. 30, 2011 in International Application No. PCT/JP2011/066812.

Notification of Grant of Invention Patent issued Apr. 5, 2016 in Chinese patent application No. 201180056706.4 (with English translation).

* cited by examiner

COMPRESSOR

BACKGROUND OF THE INVENTION

1. Technical Field

The present invention relates to a vertical split type (barrel) compressor, and in particular, to cooling of a seal structure thereof.

2. Description of the Related Art

The compressor casing (hereinafter referred to as "casing") of a vertical split type compressor generally includes components, such as rotors, blades, and so forth, in the interior thereof. In the casing, which accommodates the components therein, end lids, which are called heads, are provided at both ends in the axial direction. The heads are provided so as to confine the components from both ends in the axial direction of the casing. O-rings that prevent leakage of compression fluid are provided between the outer circumferential surfaces of the heads and the inner circumferential surface of the casing (see, for example, Japanese Examined Patent Application, Publication No. SHO-58-6079).

As a seal structure using O-rings, JP 58-6079 discloses a structure in which a recessed part is formed on the outer circumferential surface of a head, and a ring-shaped thin O-ring-retaining ring is provided in this recessed part. In this structure, the O-ring is provided by configuring an O-ring groove on the outer circumference of the O-ring-retaining ring. In addition, in this structure, an O-ring groove is also provided on the end surface of the O-ring-retaining ring (the surface orthogonal to the axial direction of the compressor), thereby providing an O-ring for sealing a gap formed with respect to the side surface of the recessed part that is provided on the outer circumferential surface of the head (the surface orthogonal to the axial direction of the compressor).

SUMMARY OF THE INVENTION

1. Technical Problem

However, with the invention described in JP 58-6079, in the case where the compression fluid between the end surface of the head and the inner circumferential surface of the casing is ethylene etc., which has low-temperature properties, the low-temperature heat thereof is transferred from the end surface of the head to the O-ring, causing the O-ring to be in a low-temperature environment. When the O-ring is in a low-temperature environment in this way, there may be a situation where the O-ring is damaged, and leakage of the compression fluid occurs due to a loss of sealability between the outer circumferential surface of the head and the inner circumferential surface of the casing.

The present invention has been made in light of the above-described circumstances and provides a compressor having a seal structure that is capable of providing effective sealing even under a low-temperature environment.

2. Solution to the Problem

In order to make improvements in the aforementioned circumstances, a compressor according to the present invention employs the following solutions.

A first aspect of the present invention is a compressor including: a substantially tubular casing; a substantially cylindrical lid that is provided inside an inner circumferential surface of the compressor casing so as to close off an end of the casing; a space that is enclosed by the lid and the inner circumferential surface of the casing and that accommodates a blade; and a seal member that is provided to extend in a circumferential direction on an outer circumferential surface of the lid which is adjacent to the space. A recessed portion extending inward in a radial direction from the outer circumferential surface of the lid is provided at a position between the seal member and an end surface at the space side of the lid.

On the lid forming the space together with the inner circumferential surface of the casing, the recessed portion extending inward in the radial direction from the outer circumferential surface of the lid is provided at a position between the end surface at the space side of the lid and the seal member provided on the lid. With the aforementioned configuration, even when the interior of the space is in a low-temperature environment, it is possible to suppress heat transfer from the space side of the lid to the seal member by means of the recessed portion. Therefore, it is possible to prevent the seal means from being damaged by the low-temperature heat in the space and to prevent leakage through a gap between the inner circumferential surface of the casing and the outer circumferential surface of the lid.

A second aspect of the present invention is a compressor including: a substantially tubular casing; a substantially cylindrical lid that is provided inside an inner circumferential surface of the compressor casing so as to close off an end of the casing; a space that is enclosed by the lid and the inner circumferential surface of the casing and that accommodates a blade; and a seal member that is provided to extend in a circumferential direction on an outer circumferential surface of the lid which is adjacent to the space. The lid is provided with a flow path that extends towards an axial center of the lid from the outer circumferential surface thereof and a cavity that is provided at the axial center of the lid and communicates with the flow path, and compressed fluid that is compressed by the blade is guided to the cavity.

The compressed fluid is guided to the cavity provided at the axial center of the lid through the flow path provided in the lid. Here, upon being compressed by the blade, the temperature of the compressed fluid becomes high. Therefore, even when the interior of the space is in a low-temperature environment, it is possible to transfer the high-temperature heat to the seal means from the axial center of the lid. Therefore, it is possible to prevent the seal means from being damaged by the low-temperature heat in the space and to prevent leakage through a gap between the inner circumferential surface of the casing and the outer circumferential surface of the lid.

In the above-described first aspect of the present invention, the lid may be provided with a flow path that extends towards an axial center of the lid from the outer circumferential surface and a cavity that is provided at the axial center of the lid and communicates with the flow path; and wherein compressed fluid that is compressed by the blade may be guided to the cavity.

It is possible to further reduce the influence of the low-temperature heat on the seal member by suppressing the heat transfer from the space side of the lid to the seal member by means of the recessed portion and by means of the heat transfer from the compressed fluid through the flow path that communicates with the cavity at the axial center of the lid. Therefore, it is possible to further prevent the seal means from being damaged by the low-temperature heat in the space.

3. Advantageous Effects of the Invention

On the lid forming the space together with the inner circumferential surface of the casing, the recessed portion extending inward in the radial direction from the outer circumferential surface of the lid is provided at a position between the end surface at the space side of the lid and the seal member provided on the lid. With the aforementioned configuration, even when the interior of the space is in a low-temperature environment, it is possible to suppress the heat transfer from the space side of the lid to the seal member by means of the recessed portion. Therefore, it is possible to prevent the seal member from being damaged by the low-temperature heat in the space and to prevent leakage through a gap between the inner circumferential surface of the casing and the outer circumferential surface of the lid.

DETAILED DESCRIPTION OF THE INVENTION

First Embodiment

Figure 1:
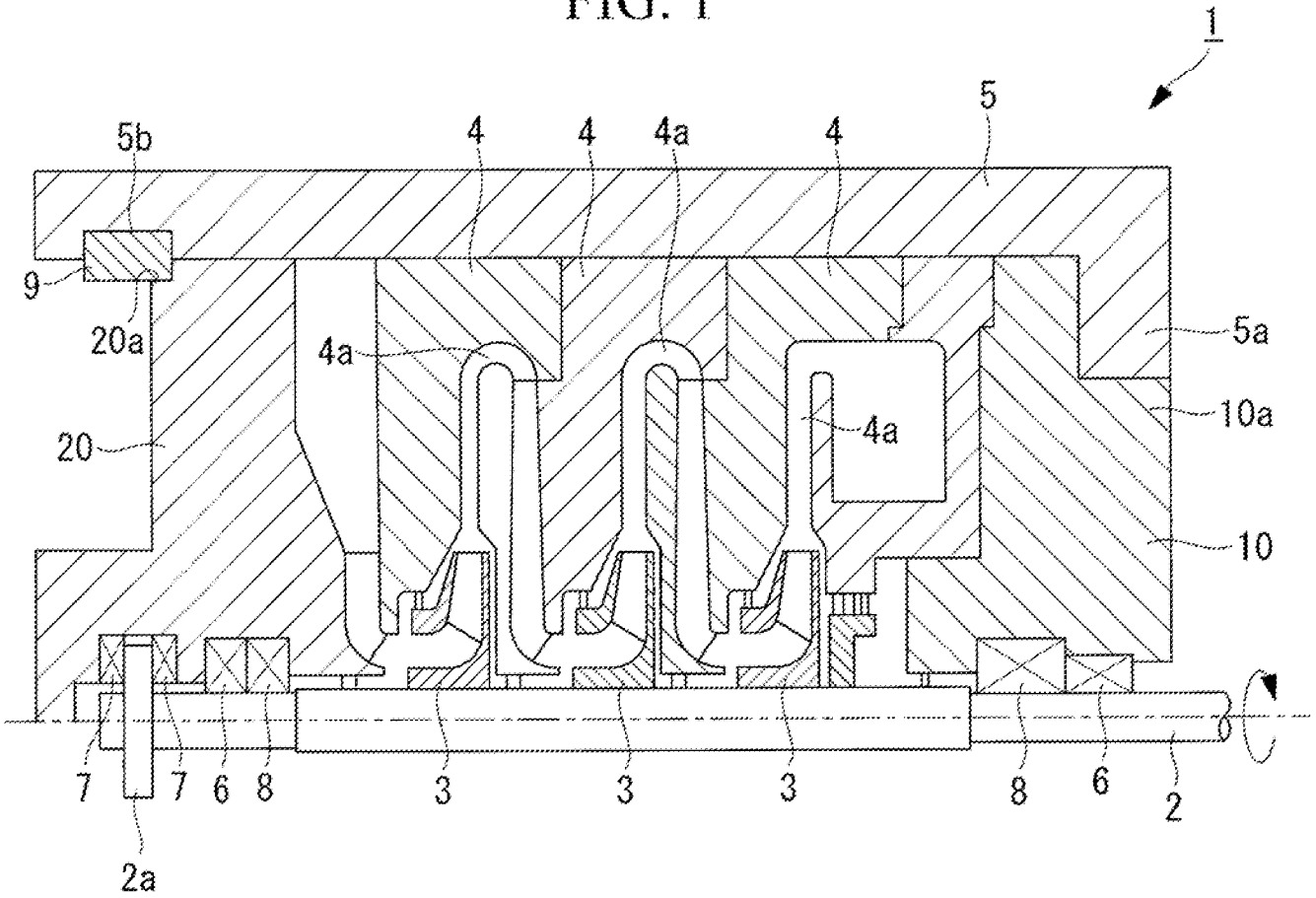
FIG. 1 is the upper half of a longitudinal sectional view showing, in outline, the configuration of a vertical split type compressor according to a first embodiment of the present invention.
Figure 2:
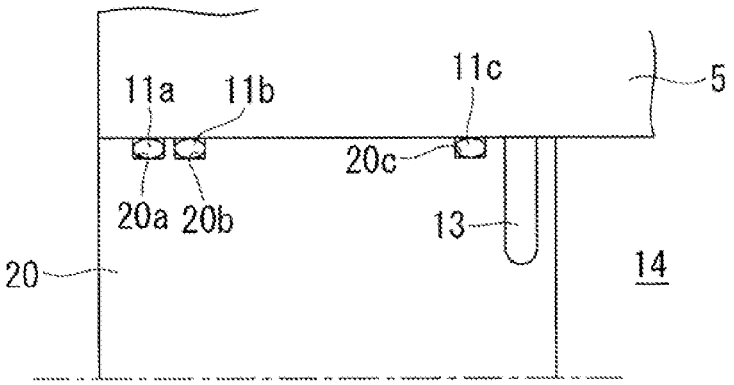
FIG. 2 is a partially enlarged view for showing a portion between a head and a casing of the compressor shown in FIG. 1.

FIG. 1 shows the upper half of a longitudinal sectional view showing, in outline, the configuration of a vertical split type compressor according to a first embodiment of the present invention, and FIG. 2 shows a partially enlarged view for showing a seal structure between a casing and a head shown in FIG. 1.

A vertical split type (hereinafter referred to as "barrel") compressor 1 is mainly formed of the elements: a substantially tubular compressor casing (hereinafter referred to as "casing") 5; components, such as a rotating shaft 2, impellers (blades) 3, and so forth, provided in the interior of the casing 5; substantially cylindrical heads (lids) 10 and 20 provided on the inner circumferential surface of the casing 5 so as to close off the ends of the tubular casing 5; a space 14 that is enclosed by the heads 10 and 20 and the inner circumferential surface of the casing 5 and that accommodates the rotating shaft 2 and the impellers 3 (see FIG. 2); and an O-ring (seal means) 11*c* that is provided, to extend in the circumferential direction, on the outer circumferential surfaces of the heads 10 and 20 at the space 14 side (see FIG. 2).

The casing 5 has a substantially cylindrical shape and is capable of accommodating the rotating shaft 2, the impellers 3, and the heads 10 and 20 in the interior thereof. The drive end (the right side in FIG. 1) of the casing 5 is provided with a step portion 5*a* that projects inward in the radial direction thereof so as to engage with a step portion 10*a* provided on the drive-end head 10, which will be described below. In addition, the non-drive end (the left side in FIG. 1) of the casing 5 is provided with a key slot 5*b* extending in the circumferential direction on the inner circumferential surface thereof so as to engage with a shear ring key 9, which will be described below.

The rotating shaft 2 is provided substantially at the center of the casing 5 such that the shaft center thereof and the center axis of the casing 5 substantially coincide. The rotating shaft 2 is connected, at the drive end thereof, to a steam turbine (not shown) etc., which is a driving source. The rotating shaft 2 is rotatably supported by journal bearings 6 in the vicinities of the drive end and the non-drive end.

In addition, a thrust collar 2*a* that protrudes outward in the radial direction of the rotating shaft 2 is provided between the journal bearing 6 provided in the vicinity of the non-drive end of the rotating shaft 2 and the non-drive end of the rotating shaft 2. The force (thrust) that is applied in the axial direction of the rotating shaft 2 is received by this thrust collar 2*a* and thrust bearings 7 that are provided on the both side surfaces (the surfaces on the drive-end side and of the non-drive-end side) of the thrust collar 2*a*. Furthermore, the impellers 3 are provided on the rotating shaft 2.

For example, three impellers 3 are provided. The impellers 3 suck and compress gas (fluid), such as, for example, ethylene, propylene, and methane, as the rotating shaft 2 is rotated. The gas compressed by the impellers 3 is guided to an inlet of the downstream impeller 3 provided at the drive-end side of the rotating shaft 2 through a flow path 4*a* provided in diaphragms 4.

For example, three diaphragms 4 are provided. The individual diaphragms 4 are provided so as to surround the respective impellers 3 at the outer side thereof in the radial direction. The diaphragms 4 have substantially the same outer diameter as the inner diameter of the casing 5. The diaphragms 4 are provided with the flow path 4*a* through which the gas that has been compressed by the impellers 3 (compressed fluid) is guided to the inlet of the downstream impeller 3.

The heads 10 and 20 are provided in the interior of the casing 5 so as to confine the impellers 3 and the diaphragms 4 from both ends in the axial direction of the casing 5. Each of the heads 10 and 20 has the journal bearing 6, which allows rotation of the rotating shaft 2, at its inner periphery side. The heads 10 and 20 have substantially the same outer diameters as the inner diameter of the casing 5. In addition, each of the heads 10 and 20 is provided with, on the inner periphery side thereof, a gas seal 8 at the impeller 3 side of the journal bearing 6. The gas seals 8 prevent leakage of the gas (compressed fluid), which has been compressed by the impellers 3, through the gap between the rotating shaft 2 and the respective heads 10 and 20.

The heads 10 and 20 consist of the drive-end head 10 and the non-drive-end head 20. The drive end of the drive-end head 10 is formed with a step portion 10*a* that is recessed radially inward so as to be engaged with the above-mentioned step portion 5*a* of the casing 5. In addition, the radially outside portion of the non-drive end of the non-drive-end head 20 is provided with a mating portion 20*a* that restricts movement of the non-drive-end head 20 in the axial direction of the casing 5 by fitting with the shear ring key 9 which is fitted into the key slot 5*b* provided on the inner circumferential surface of the above-mentioned casing 5.

The shear ring key 9 has a ring shape whose cross-section orthogonal to the axial direction of the casing 5 has a substantially quadrangular shape. As described above, the shear ring key 9 is fitted so as to connect the key slot 5*b* provided on the inner circumferential surface of the casing 5 and the mating portion 20*a* provided on the radially outside portion of the non-drive-end head 20. By fitting the shear ring key 9 between the key slot 5*b* and the mating portion 20*a* in this manner, the movement of the non-drive-end head 20 in the axial direction of the casing 5 is restricted.

Next, a seal structure between the non-drive-end head 20 and the casing 5 shown in FIG. 1 will be described using FIG. 2. Here, the right-hand side in FIG. 2 shows the space 14 holding the gas that has been compressed by the impellers 3 (see FIG. 1).

Three O-ring grooves 20*a*, 20*b*, and 20*c* are provided so as to extend in the circumferential direction in the vicinities of both end portions of the outer circumferential surface of the non-drive-end head 20. The O-ring grooves 20*a* and 20*b* are provided in the vicinity of the left end portion on the outer circumferential surface of the non-drive-end head 20 in FIG. 2, and the O-ring groove 20*c* is provided in the vicinity of the end portion at the space 14 side (the right side in FIG. 2) on the outer circumferential surface of the non-drive-end head 20.

These O-ring grooves 20*a*, 20*b*, and 20*c* are provided with O-rings 11*a*, 11*b*, and 11*c*, respectively.

A recessed portion 13 extending inward in the radial direction from the outer circumferential surface of the non-drive-end head 20 is provided in the non-drive-end head 20 between the O-ring groove 20*c* and the end surface at the space 14 side. Note that, the dimension of the recessed portion 13 extending inward in the radial direction is longer than that of the ring groove 20*c*, and that the recessed portion 13 has a width (the distance in the axial direction of the non-drive-end head 20) that is capable of suppressing the transfer of low-temperature heat from the space 14 in the axial direction of the non-drive-end head 20.

Next, the situation where the space 14 shown in FIG. 2 is in a low-temperature environment will be described.

In the case where the compressed fluid in the space 14 is ethylene, for example, the space 14 becomes a low-temperature environment (about −100° C.). The low-temperature heat is transferred to the non-drive-end head 20 from the space 14 that is in the low-temperature environment.

The low-temperature heat that has been transferred from the space 14 to the non-drive-end head 20 is further transferred in the axial direction in the non-drive-end head 20 from the end surface at the space 14 side of the non-drive-end head 20 towards the opposite end surface (from the right to the left in FIG. 2). The low-temperature heat that has been transferred from the space 14 in the axial direction of the non-drive-end head 20 reaches the recessed portion 13 provided in the non-drive-end head 20.

Here, because the recessed portion 13 is provided in the non-drive-end head 20, heat transfer to the downstream side of the recessed portion 13 (to the left side in FIG. 2) is suppressed. Therefore, the transfer of the low-temperature heat to the O-ring 11*c* provided downstream of the recessed portion 13 is suppressed.

As described above, the following advantages and effects can be achieved by the compressor 1 according to this embodiment.

The non-drive-end head (lid) 20, which is forming the space 14 together with the inner circumferential surface of the casing 5, is provided with the recessed portion 13 extending inward in the radial direction from the outer circumferential surface of the non-drive-end head 20 at a position between the end surface at the space 14 side of the non-drive-end head 20 and the O-ring (seal means) 11*c* provided on the non-drive-end head 20. With the aforementioned configuration, even when the interior of the space 14 is a low-temperature environment, where the temperature is −100° C. or lower, it is possible to suppress heat transfer from the space 14 side of the non-drive-end head 20 to the O-ring 11*c* by means of the recessed portion 13. Therefore, it is possible to prevent the O-ring 11*c* from being damaged by the low temperature from fluid, such as ethylene gas etc., in the space 14 and therefore to prevent leakage of ethylene gas through the gap between the inner circumferential surface of the casing 5 and the outer circumferential surface of the non-drive-end head 20.

Note that this embodiment has been described assuming that ethylene gas is employed, However, other gases having a boiling point of −100° C. or lower, such as propylene, methane, and so forth, can also be employed.

Second Embodiment

The compressor of this embodiment differs from that of the first embodiment in that the head does not have the recessed portion and has a cavity to which hot gas is guided therein, but other components are the same. Therefore, the same components are assigned the same reference numerals, and a description thereof shall be omitted.

Figure 3A:
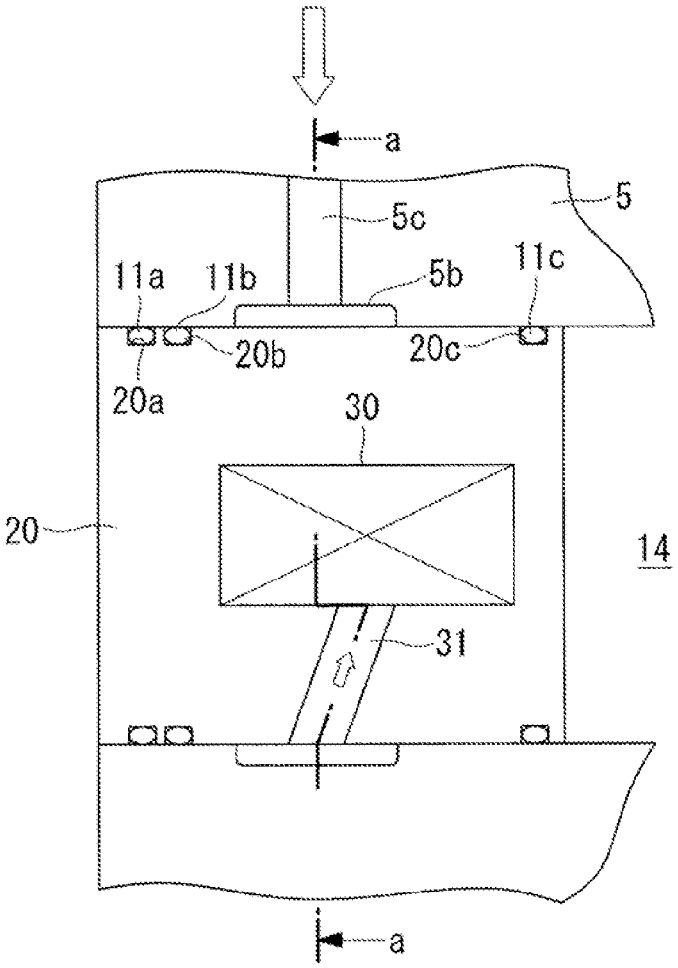
FIG. 3A is a longitudinal sectional view showing, in outline, the configuration of a head and a casing of a vertical split type compressor according to a second embodiment of the present invention.
Figure 3B:
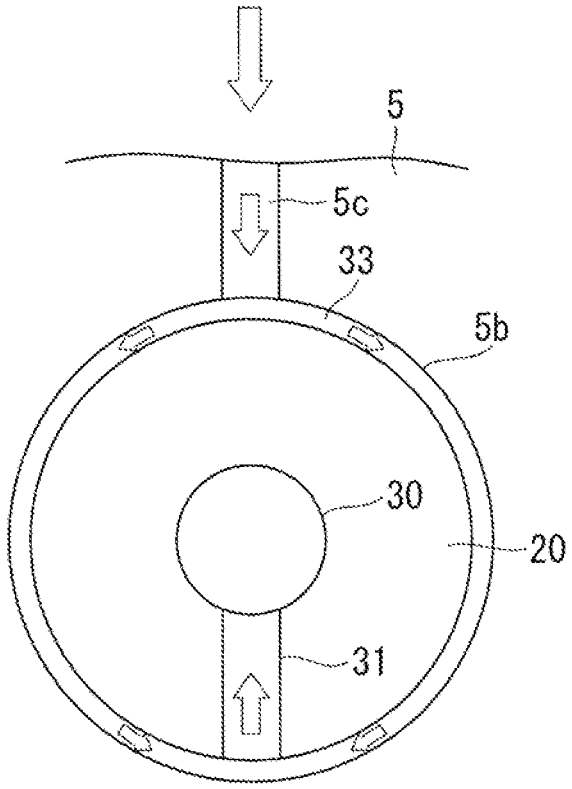
FIG. 3B is a sectional view taken along a-a shown in FIG. 3A.

FIGS. 3A and 3B show the seal portion of this embodiment, where FIG. 3A is a longitudinal sectional view showing, in outline, the configuration thereof, and FIG. 3B is a sectional view taken along a-a shown in FIG. 3A.

A gas seal portion (cavity) 30 is provided substantially at the center portion of the non-drive-end head (lid) 20. The gas seal portion 30 is a substantially cylindrical part that has its longitudinal direction laying along the axial direction of the non-drive-end head 20 and is provided substantially concentrically with the non-drive-end head 20, as shown in FIG. 3B. The position of the gas seal portion 30 is shifted toward the space 14 side in the non-drive-end head 20 in the longitudinal direction thereof.

In addition, as shown in FIGS. 3A and 3B, the gas seal portion 30 is provided with a communicating channel 31 that extends outward in the radial direction of the non-drive-end head 20 from the bottom part of the gas seal portion 30 and opens at the outer circumferential surface of the non-drive-end head 20. The communicating channel 31 opens at the outer circumferential surface of the non-drive-end head 20 between the O-ring groove 20*b* and the O-ring groove 20*c*.

The casing 5 has, at a part of its inner circumferential surface, a dent portion 5*b* dented outward in the radial direction. As shown in FIG. 3B, the dent portion 5*b* is provided so as to extend in the circumferential direction on the inner circumferential surface of the casing 5, and the dent portion is substantially concentric with the gas seal portion 30. In addition, a flow path 5*c* that communicates with the dent portion 5*b* is provided above the non-drive-end head 20. The flow path 5*c* extends outward in the radial direction from the dent portion 5*b* and opens at the outer circumferential surface of the non-drive-end head 20.

Next, the situation where the space 14 shown in FIG. 3A is in a low-temperature environment will be described.

In the case where the gas in the space 14 is ethylene gas (fluid), the space 14 becomes a low-temperature environment (about −100° C.). With the space 14 that is a low-temperature environment as described above, low-temperature heat is transferred from the space 14 to the non-drive-end head 20.

The low-temperature heat that has been transferred from the space 14 of the non-drive-end head 20 to the non-drive-end head 20 is further transferred in the axial direction in the non-drive-end head 20 from the end surface at the space 14 side of the non-drive-end head 20 towards the opposite end surface (from the right to the left in FIG. 3A).

Here, ethylene gas (compressed fluid) that has been compressed by the impellers 3 (see FIG. 1) is guided to the flow path 5*c* provided in the non-drive-end head 20. As the ethylene gas is compressed by the impellers 3, the temperature thereof is increased. As shown by a white arrow in FIG. 3B, the compressed ethylene gas whose temperature has increased in such a manner (hereinafter referred to as "hot gas") is discharged to the dent portion 5*b* provided in the inner circumferential surface of the casing 5 through the flow path 5*c* of the casing 5.

As shown in FIG. 3B, because a ring-shaped flow path 33 is formed between the dent portion 5*b* provided on the inner circumferential surface of the casing 5 and the outer circumferential surface of the non-drive-end head 30, the hot gas discharged to the dent portion 5*b* flows from above the non-drive-end head 20 to below the non-drive-end head 20 through the ring-shaped flow path 33.

In this way, the hot gas flows along the outer circumferential surface of the non-drive-end head 20 so as to form a ring shape, thereby transferring heat of the hot gas passing through the ring-shaped flow path 33 to the non-drive-end head 20.

The hot gas that has flowed to below the non-drive-end head 20 is guided to the interior of the non-drive-end head 20 from the communicating channel 31 that opens at the lower part of the non-drive-end head 20. Because the communicating channel 31 communicates with the gas seal portion 30 and the outer circumferential surface of the non-drive-end head 20, the hot gas is fed to the gas seal portion 30 by being guided toward the gas seal portion 30.

In the process of supplying the hot gas to the gas seal portion 30 that is provided in the interior of the non-drive-end head 20, the heat of the hot gas is transferred to the non-drive-end head 20.

As described above, it is possible to reduce the influence of the low-temperature heat that is transferred to the O-ring (seal means) 11*c*, which is provided in the non-drive-end head 20, from the space 14 in the low-temperature environment by the high-temperature heat of the hot gas transferred to the non-drive-end head 20 from the ring-shaped flow path 33.

As described above, the following advantages and effects can be achieved by the compressor according to this embodiment.

The hot gas (compressed fluid) is guided to the gas seal portion 30 provided at the axial center of the non-drive-end head 20 through the penetrating portion (flow path) 31 provided in the non-drive-end head (lid) 20. Here, by being compressed by the impellers 3 (see FIG. 1), the temperature of the hot gas (ethylene gas) is high. Therefore, even when the interior of the space 14 is a low-temperature environment, it is possible to transfer the high-temperature heat to the O-ring (seal means) 11*c* from the axial center of the non-drive-end head 20. Therefore, it is possible to prevent the O-ring 11*c* from being damaged by the low-temperature heat in the space 14 and therefore to prevent leakage of ethylene gas from a gap between the inner circumferential surface of the casing 5 and the outer circumferential surface of the non-drive-end head 20.

Third Embodiment

The compressor of this embodiment differs from that of the first embodiment in that the flow path portion into which the hot gas is guided is provided in the head, but other components are the same. Therefore, the same components are assigned the same reference numerals, and descriptions thereof shall be omitted.

The gas seal portion is provided substantially at the center of the non-drive-end head (lid) 20 (see FIG. 1). The gas seal portion is provided such that its longitudinal direction lays along the axial direction of the non-drive-end head 20 and so as to be substantially concentric with the non-drive-end head 20. The position of the gas seal portion is shifted toward the space side of the non-drive-end head 20 in the longitudinal direction thereof.

In addition, the gas seal portion is provided with the communicating channel that extends outward in the radial direction of the non-drive-end head 20 from the bottom part of the gas seal portion and opens at the outer circumferential surface of the non-drive-end head 20. The communicating channel opens at the outer circumferential surface of the non-drive-end head 20 between the O-ring groove 20*b* and the O-ring groove 20*c*.

The casing 5 has, at a part of its inner circumferential surface, the dent portion dented outward in the radial direction. The dent portion is provided so as to extend in the circumferential direction of the inner circumferential surface of the casing 5, and the dent portion is substantially concentric with the gas seal portion. In addition, the flow path that communicates with the dent portion is provided above the non-drive-end head 20. The flow path extends outward in the radial direction from the dent portion and opens at the outer circumferential surface of the non-drive-end head 20.

As described above, the following advantages and effects can be achieved by the compressor according to this embodiment.

It is possible to further reduce the influence of the low-temperature heat to the O-ring 11*c* by suppressing the heat transfer from the space 14 side of the non-drive-end head (lid) 20 to the O-ring (seal means) 11*c* with the recessed portion 13 and by means of the heat transfer from the hot gas (compressed fluid) in the gas seal portion (cavity) provided at the axial center of the non-drive-end head 20. Therefore, it is possible to further prevent the O-ring 11*c* from being damaged by the low-temperature heat in the space 14.

In addition, in the first to third embodiments, the recessed portion 13 and the gas seal portion 30 (see FIGS. 3A and 3B) are described as being provided in the non-drive-end head 20. However, similarly, the recessed portion 13 and the gas seal portion 30 may be provided in the space 14 side of the drive-end head 10.

REFERENCE SIGNS LIST

1 compressor
3 impeller (blade)
5 casing
10, 20 lid (head, drive-end head, non-drive-end head)
11*c* seal means (O-ring)
13 recessed portion
14 space
30 gas seal portion
31 flow path (communicating channel)

The invention claimed is:

1. A compressor comprising:

a substantially tubular casing;

a substantially cylindrical lid that is provided inside an inner circumferential surface of the compressor casing so as to close off an end of the casing;

a space that is enclosed by the lid and the inner circumferential surface of the casing and that accommodates a blade; and a seal member that is provided to extend in a circumferential direction on an outer circumferential surface of the lid which is adjacent to the space, wherein the lid is provided with a flow path that extends towards an axial center of the lid from the outer circumferential surface thereof and a cavity that is provided at the axial center of the lid and communicates with the flow path, and wherein compressed fluid that is compressed by the blade is guided to the cavity.

2. A compressor comprising:

a substantially tubular casing;

a substantially cylindrical lid that is provided inside an inner circumferential surface of the compressor casing so as to close off an end of the casing;

a space that is enclosed by the lid and the inner circumferential surface of the casing and that accommodates a blade; and a seal member that is provided to extend in a circumferential direction on an outer circumferential surface of the lid which is adjacent to the space, wherein a recessed portion extending inward in a radial direction from the outer circumferential surface of the lid is provided at a position between the seal member and an end surface at the space side of the lid;

wherein the lid is provided with a flow path that extends towards an axial center of the lid from the outer circumferential surface and a cavity that is provided at the axial center of the lid and communicates with the flow path; and wherein compressed fluid that is compressed by the blade is guided to the cavity.

* * * * *